United States Patent [19]

Walker

[11] 4,072,446

[45] Feb. 7, 1978

[54] ELECTROMAGNETICALLY DRIVEN PUMPS

[75] Inventor: Alan John Walker, Dornoch, Scotland

[73] Assignee: R. E. Dupont Research and Investment Services Limited, Isle of Man, United Kingdom

[21] Appl. No.: 661,038

[22] Filed: Feb. 24, 1976

[30] Foreign Application Priority Data

Jan. 20, 1976 United Kingdom ..... 2150/76

[51] Int. Cl.[2] ..... F04B 17/00

[52] U.S. Cl. ..... 417/420

[58] Field of Search ..... 417/420, 424, 366, 372, 417/373; 415/170 A; 310/54, 58, 60, 63, 103, 104

[56] References Cited

U.S. PATENT DOCUMENTS

| | | | |
|---|---|---|---|
| 2,154,199 | 4/1939 | Colwell et al. | 415/170 A |
| 2,566,743 | 9/1951 | Okulitch et al. | 417/420 |
| 3,001,479 | 9/1961 | Swenson et al. | 417/420 |
| 3,060,860 | 10/1932 | Schaefer | 417/373 |
| 3,405,295 | 10/1968 | Daley et al. | 310/104 |
| 3,643,120 | 2/1972 | Young et al. | 310/103 X |
| 3,741,690 | 6/1973 | Laing | 417/420 |

*Primary Examiner*—William L. Freeh
*Assistant Examiner*—Edward Look
*Attorney, Agent, or Firm*—William F. Frank

[57] ABSTRACT

The invention resides in a rotary machine in which an electromagnetic spherically shaped armature and a pump impeller being enclosed in a casing are born, as a unit, by a frusto-spherical bearing of which the convex (or ball) part rotates, and in which frictional rotatable seal means are carried by an annular wall extending inwardly of the casing between armature and impeller supports the fixed bearing part and sealing means which isolate the spaces in which run the armature and the impeller respectively.

8 Claims, 3 Drawing Figures

ELECTROMAGNETICALLY DRIVEN PUMPS

BACKGROUND OF THE INVENTION

The invention is related to machines which are or include electromagnetically driven pumps or compressors (hereinafter for brevity termed "pump") for fluids, in which an electric rotating armature forms in effect a single rotating unit with the pump impeller or runner and is borne by a frusto-spherical surface and wherein the armature is separated from the electric motor stator by a magnetically permeable fluid-tight wall located in the space usually called the "air gap" (though we are not concerned here with air as such).

In some such machines the pump may be driven by a rotating concave pole ring (or "field") of permanent magnetic material, arranged outside the wall and itself driven by a separate source such as an electric motor or other mechanical drive source: in such case, the two relatively rotatable magnetic elements constitute a coupling rather than a motor; and in the following the terms "motor" and "coupling" are when contextually appropriate, regarded as including both.

The rotary unit or assembly of such machines is subject to axial magnetic forces, i.e. to axial thrust in one sense of direction.

Pumps in such machines are usually such that the impeller is subject to hydraulic force (the term includes fluid force) which is opposed in sense to the magnetic force thrust above mentioned. At high delivery pressures the impeller, and therefore the rotating unit of which it is a part, is subject to a hydraulic thrust towards the intake side or "eye" of the pump casing. If this hydraulic thrust exceeds the magnetic thrust force above mentioned, then the known bearing arrangement consisting of complementary concave and convex frusto-spherical components is no longer effective. This results in a design limitation in such machines.

The present invention seeks to avoid such limitation making it practicable to construct pumps particularly those intended for larger output and maybe those wherein a high fluid pressure is generated.

A further drawback of previously proposed pumps is their sensitivity to contamination of the pumped fluid especially if such contamination includes magnetically responsive particles. Contaminant particles are apt to be deposited in the "air gap".

In order to avoid these drawbacks the invention provides that a second wall, which is stationarily mounted between the armature and the impeller, is provided with a seal affording rotational freedom which seal includes part of the frusto-spherical surface of the bearing and is resiliently loaded by the wall itself or resilient means carried by the wall.

SUMMARY OF THE INVENTION

According to this invention, in a combined motor and pump in which the rotor (i.e. the magnetic armature and the impeller) is borne by a single spherical bearing there is provided a wall which hermetically separates the impeller chamber from the armature chamber, which wall is sealed to the convex element (ball) of the bearing, sealing being maintained by resilience either of the wall itself, or an elastic extension thereof (such as a bellows structure) or by sealing means which is axially loaded by a resilient ring such as an elastomeric O-ring.

Preferably, the invention includes the provision of additional bearing elements such as to resist the axial component of the magnetic forces. In this way, the support of the armature/impeller unit is ensured both during running and when switching off when there is no magnetic thrust. As soon as the hydraulic forces exert a preponderant (over the magnetic) thrust on the impeller in the sense of direction towards the intake or upstream side of the pump casing excede the axial magnetic force the invention provides for a support by the bearing such bearing being supported by the intermediate wall. This "bearing" may comprise a shaft seal, the components of which have complementary axially opposed surfaces.

DESCRIPTION OF EXAMPLES OF THE INVENTION

Examples of the invention will be described with the help of the accompanying drawings in which.

Figure 1:
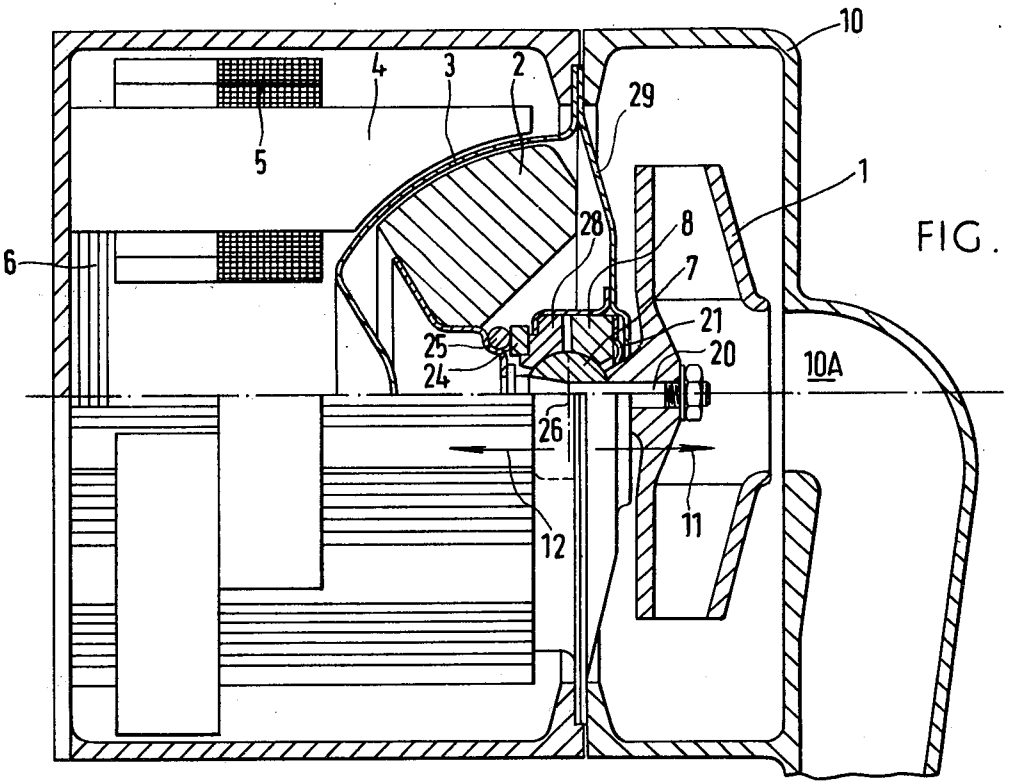
FIG. 1 shows an arrangement in which the armature/impeller unit is borne by a ball supported by a bearing cup which is carried in an intermediate wall and in which there is a non-rotary seal.

FIG. 1 illustrates a motorised centrifugal pump in which the impeller 1 is part of a unit rigidly assembled with the armature 2. The surface of the armature 2 facing the magnetically permeable separating first wall 3 is frusto-spherical. The wall 3 is located in the air gap between the armature 3 and the stator. The stator consists of magnetically conducting poles 4, coils 5, and magnetic loop closure element 6. A ball 7 being the rotatable part of the frusto-spherical bearing is rigidly attached to the armature/impeller rotating unit 1–2 and is therefore itself rotating. In operation; the impeller 1 generates a fluid force, i.e. thrust in the sense of the arrow 11, whilst there is magnetically generated a thrust force in the (opposite) sense of the arrow 12.

The impeller 1 is attached to the armature 2 by a bolt 20, a ball 7 being fast with the bolt 20. The ball 7 is nested between two non-rotating concave bearing cups 8 and 28. The bearing cups 8, 28 are carried by a fixed annular second wall 29. A resilient portion 21, axially urges the cups 8 and 28 towards each other and against the surface of the ball 7. The thrust forces in the senses of direction of the arrows 11 and 12 are both resisted by the frusto-spherical bearing formed by the ball 7 and the cups 8, 28. A non-rotating seal ring 24 is pressed by an elastomeric O-ring 25 against a plane surface of the ring 24 which ring 24 is in turn elastically pressed against the bearing cup 28. The angle of wobbling or precession motion which the ball 7 (and rotor unit as a whole) can perform in relation to the axis 26 is limited by the elasticity and limits of the ring 25. The wall 29 perferably hermetically contains the pumped fluid medium, which, as is known in practice may contain abrasive, precipitating, or otherwise contaminating substances which may include magnetic particles.

Figure 2:
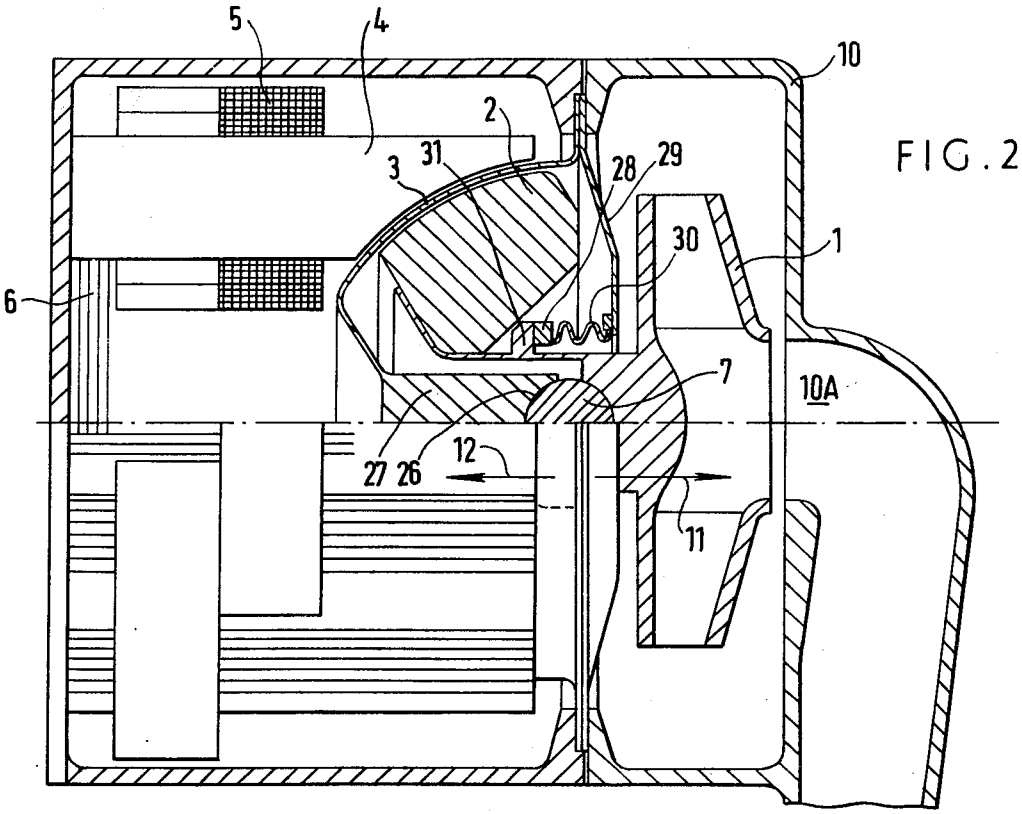
FIG. 2 shows an embodiment in which a rotary shaft seal is carried by the intermediate wall.

FIG. 2 shows another embodiment of a motorised pump machine in which the impeller 1 forms a rotary unit with the armature 2. The surface of the armature 2 complementarily facing the magnetically permeable separating wall 3 is spheroidal. A stator is situated to one side of the wall 3. The stator consists of magnetically conductive poles 4, coil 5 and magnetic loop closure element 6. The bearing ball 7 is attached fixedly to the rotating unit 1, 2. The ball 7 is borne by a concave bearing cup 26. This cup 26 is supported by the wall 3 through a tubular element 27. An elastic bellows-type body 30 is attached to the second annular wall 29. The body 30 carries a sealing ring 28 which presses axially against the flat annular surface of a co-operating seal ring 31.

In operation, the impeller 1 generates fluid-pressure thrust force in the sense of the arrow 11, whilst the armature 2 generates magnetic thrust force in the sense of arrow 12, these forces being in general, axial in respect of the rotation. The latter force is resisted by the bearing cup 26. When the force along arrow 11 exceeds the force along arrow 12, the seal 31, 28 supported by the bellows 30 resists this excess force.

Figure 3:
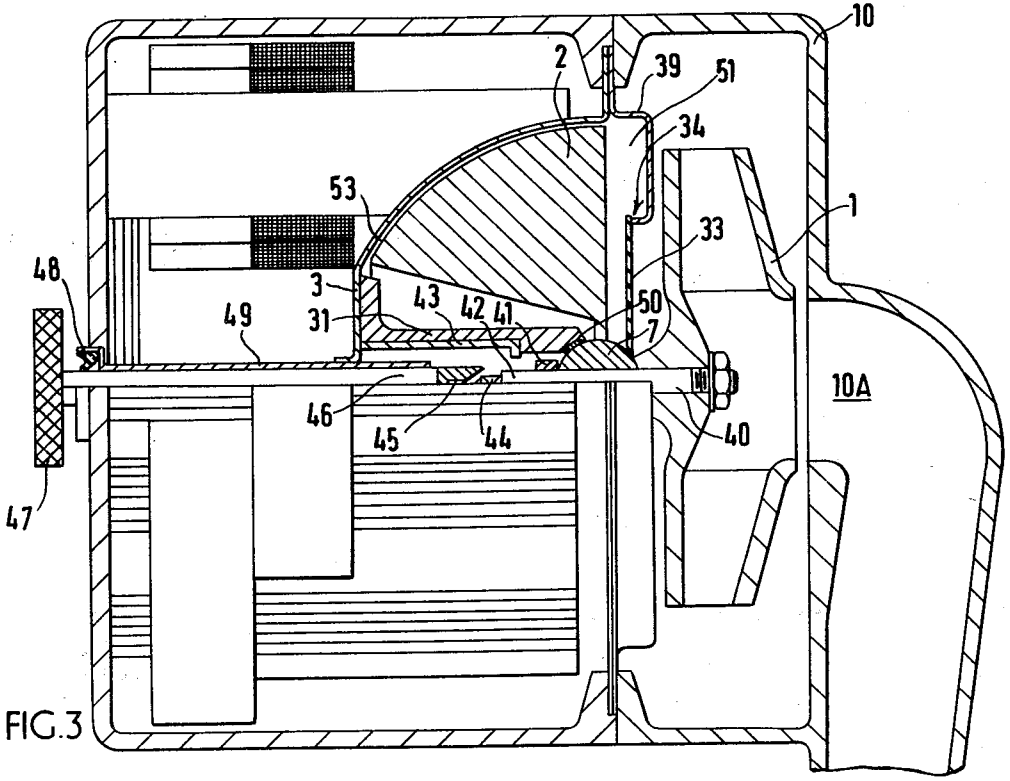
FIG. 3 shows a variant of FIG. 2 in which the bearing ball is comprised both in a bearing and a bearing seal.

FIG. 3 shows a further variant of the machine in which the ball 7 is both the rotating convex member of a bearing comprising the cupped end surface 50 of the bearing column 31 and also constitutes the rotating member of a rotary seal, of which the stationary part is constituted by an annular second wall part 39 against which bears (at 34) an axially elastic portion 33 of which the inner margin sealedly contacts the ball 7 (for which reason the margin is preferably machined as a frusto-spherical surface, but it may be left as an edge with will rapidly adapt itself to sealing contact with the ball 7).

The element 33 is preferably made very thin and of a hard though elastic material and is assembled normally in fluid-tight (but relief-valve like) manner, the element 33 acting as a wall partly defining a chamber, as the spring of a rotary seal, and as the spring of a one-way relief valve. The element 33 is therefore intended to be resiliently preloaded in the axial sense, when assembled, against the edge 34 of a relatively rigid intermediate annular second wall part 39.

The armature 2 is shrunk on or otherwise rigidly attached to the equator of the ball 7. A spindle 40 traverses the ball 7. The spindle 40 carries on one side of the ball 7 the bladed impeller 1 and on the other side of the ball 7 is a ring 41 which holds the ball 7 in its axial position on the spindle 40 by friction locking.

The stub 42 of the spindle 40 together with a bush 43 provide limitation of precessional wobbling of the armature/impeller unit 1, 2. The end of the spindle 40 is formed with a square section at 44, which can fit into a square sectioned socket 45 situated at the end of a rod 46.

By axial displacement of an externally accessible handwheel 47, the rod 46, which is sealed by a rubber seal 48, can be shifted axially far enough so that the armature/impeller unit 1, 2 can be turned by hand should occasion arise, e.g. in case a foreign body has caused jamming.

The rod 46 is carried in bush 49 in a manner such as to allow rotary and axial motions. The bush 49 is fluid-tightly secured to the separating wall 3.

The element 33 fulfills four functions in this variant:

a. it seals the space 51 in which runs the armature 2 against possibly contaminated fluid from the space in which the bladed impeller 1 runs so as to prevent foreign matter from reaching the air gap at 53.

b. it prevents separation of the ball 7 from its complementary concave spherical bearing surface at 50.

c. if an excess pressure forms in the space 51, for example because overheating causes the fluid in this space to evaporate, the element 33 acting like a relief valve lifts off the ball 7 and thus relieves excess pressure.

d. if negative pressure occurs in the space 51, for example because previously formed vapour condenses after switching off the motor, the sealing disc 33 (acting as a relief valve) suffers a small deflection so that its periphery lifts off the edge 34 of the intermediate plate 39 and allows passage of fluid.

In each variant the casing 10 contains the electric motor (for which of course all appropriate provision such as connectors will be made) and the impeller. The fluid enters the casing 10 through an axially-directed inlet eye 10A and the impeller is, as shown, of centrifugal type.

I claim:

1. An electromagnetically driven pump comprising:

a casing adapted to house a rotatable unit comprised by an impeller and an armature and having a fluid-inlet opening to lead fluid into the casing to the impeller in a direction parallel to the impeller axis of rotation;

a stator having a frusto-spherical magnetically effective surface complementary to that of the armature and spaced therefrom to form an air gap;

frusto-spherical bearing means for said rotatable unit said means having its convex part rotatable with the said unit and its concave part non-rotatably mounted;

a fluid-tight wall of frusto-spherical formation and of magnetically permeable material fixedly located in the air gap between the armature and the stator; and an annular second wall extending generally radially between the impeller and the armature, said second wall comprising an outer annular portion and an inner rotary frictional seal means arranged to be operative between said second wall outer portion and said rotatable unit and to be resiliently urged in a direction parallel to the axis of rotation of the machine and to allow appreciable precessional freedom of motion of the axis of rotation of the rotatable unit about the geometric centre of the frusto-spherical bearing means, said seal means comprising an annular resilient portion of which the inner margin bears frictionally upon and in sealing contact with the convex part of said bearing means upon which said margin additionally exerts thrust upon said convex part in a direction parallel to the axis of rotation thereof;

the stator, rotatable unit, bearing and seal means all being constructed and assembled so that in their spherical relationship they are concentric.

2. A machine according to claim 1, in which additional bearing means are provided to restrict the rotatable unit from precession beyond a selected limit of angle.

3. A machine according to claim 1, in which there is further provided externally accessible means operable by movement axially in respect to the rotatable unit and so as to engage the rotatable unit and move it in relation to the stator whereby to release foreign matter which may lodge between rotor and stator element of the machine.

4. A machine according to claim 1 in which the said annular resilient portion is so adapted that it can operate as a relief valve should the pressure to which it is subjected so dictate.

5. An electromagnetically driven pump comrising:

a casing adapted to house a rotatable unit comprised by an impeller and an armature and having a fluid-inlet opening to lead fluid into the casing to the impeller in a direction parallel to the rotational axis of said impeller;

a stator having a frusto-spherical magnetically effective surface complementary to that of the armature and spaced therefrom to form an air gap;

frusto-spherical bearing means for said rotatable unit having its convex part rotatable with the said unit and its concave part non-rotatably mounted;

a fluid-tight wall of frusto-spherical formation and of magnetically permeable material fixedly located in the air gap between the armature and the stator; and an annular second wall extending generally radially between the impeller and the armature, said second wall comprising an outer annular portion and an inner rotary frictional seal means arranged to be operative between said second wall outer portion and said rotatable unit and resiliently urged in a direction parallel to the axis of rotation of the machine and to allow appreciable precessional freedom of motion of the axis of rotation of the rotatable unit about the geometric centre of the frusto-spherical bearing means, in which said second wall seal means comprises an annular resilient portion of which the inner margin bears frictionally and in sealing contact with the convex part of the bearing means upon which said margin exerts thrust upon the convex part in the direction of the axis of rotation thereof and thrust upon an annular frusto-spherical bush bearing carried by said fluid-tight wall, and sealing against the convex element of the bearing means by virtue of axial load imposed by said inner margin.

6. A machine comprising: a pump casing and an electric motor stator mounted in said casing; an electric motor armature and a pump impeller forming a rotor unit, the armature having a frusto-spherical shape; the armature and the stator being spaced apart to form an air gap; a magnetically permeable separating wall fixed in said gap; and frusto-spherical bearing means for the rotor unit which is prevented from axial movement toward the stator by the bearing means, which is supported by the separating wall, the bearing means comprising a rotating ball and a concave non-rotating bush; said impeller being fixedly attached to said ball by said spindle, said armature being fixedly attached to the equatorial region of said ball and spaced from said impeller, the region of the ball opposite the impeller cooperating with said bush to form a bearing; and a fixed second wall extending radially in the space between said armature and said impeller and having an inner portion which cooperates with the portion of the ball lying between the attachments of the armature and impeller to said ball to constitute a seal.

7. A machine according to claim 6, in which the bearing is adapted to act as a rotary seal which prevents the ingress of dirt into the space in which runs the armature.

8. A machine according to claim 6, in which the spindle extends through the ball and is surrounded by a bush thus providing means to limit freedom of angular precession of the rotor assembly relative to the stator.

* * * * *